US009791818B2

(12) United States Patent
Kim et al.

(10) Patent No.: US 9,791,818 B2
(45) Date of Patent: Oct. 17, 2017

(54) IMAGE FORMING APPARATUS AND METHOD FOR REDUCING IMAGE BANDING OF THE IMAGE FORMING APPARATUS

(71) Applicant: Samsung Electronics Co., Ltd., Suwon-si (KR)

(72) Inventors: Soo Yong Kim, Suwon-si (KR); Sang Bum Woo, Yongin-si (KR); Chang Yong Sung, Busan (KR); Jae Il Yu, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/476,114

(22) Filed: Sep. 3, 2014

(65) Prior Publication Data

US 2015/0110536 A1 Apr. 23, 2015

(30) Foreign Application Priority Data

Oct. 17, 2013 (KR) ..... 10-2013-0123977

(51) Int. Cl.
*G03G 15/00* (2006.01)

(52) U.S. Cl.
CPC ..... *G03G 15/6564* (2013.01); *G03G 15/6558* (2013.01); *G03G 2215/00405* (2013.01); *G03G 2215/00556* (2013.01); *G03G 2215/00721* (2013.01); *G03G 2215/00945* (2013.01)

(58) Field of Classification Search
CPC ..... G03G 15/6558; G03G 15/6561; G03G 15/6564; G03G 2215/00405; G03G 2215/00721; G03G 2215/00945
See application file for complete search history.

(56) References Cited

U.S. PATENT DOCUMENTS

| | | | | |
|---|---|---|---|---|
| 5,119,146 | A | 6/1992 | Nobumori et al. | |
| 6,092,803 | A | 7/2000 | Munenaka | |
| 6,185,381 | B1 * | 2/2001 | Nakahara | G03G 15/231 271/258.01 |
| 7,756,463 | B2 * | 7/2010 | Takahashi | G03G 15/6567 399/381 |
| 2005/0074267 | A1 | 4/2005 | Demchock et al. | |
| 2010/0303530 | A1 * | 12/2010 | Inoue | G03G 15/6564 399/396 |

FOREIGN PATENT DOCUMENTS

WO 2014/119240 8/2014

OTHER PUBLICATIONS

European Search Report dated Nov. 26, 2014 in European Patent Application No. 14182943.2.

* cited by examiner

*Primary Examiner* — Justin Olamit
(74) *Attorney, Agent, or Firm* — Staas & Halsey LLP

(57) ABSTRACT

An image forming apparatus and a method of reducing image banding of the image forming apparatus is provided. The image forming apparatus includes: a photoconductor unit on which an electrostatic latent image is formed; and a conveying unit configured to convey printing medium at a first conveying velocity toward the photoconductor unit, and configured to convey the printing medium at a second conveying velocity that is lower than the first conveying velocity when the printing medium approaches the photoconductor unit.

18 Claims, 15 Drawing Sheets

IMAGE FORMING APPARATUS AND METHOD FOR REDUCING IMAGE BANDING OF THE IMAGE FORMING APPARATUS

CROSS-REFERENCE TO RELATED APPLICATIONS

This application claims the priority benefit of Korean Patent Application No. 10-2013-0123977, filed on Oct. 17, 2013 in the Korean Intellectual Property Office, the disclosure of which is incorporated herein by reference.

BACKGROUND

1. Field

Embodiments of the present disclosure relate to an image forming apparatus, and a method of reducing image banding of the image forming apparatus.

2. Description of the Related Art

An image forming apparatus is an apparatus that can print an image on printing medium such as a printing paper. The image forming apparatus includes a printer, a copier, a facsimile system, and a multifunction machine having all or a part of functions of a printer, a copier, and a facsimile system.

The image forming apparatus can be classified into an ink jet type and an electrophotographic type. An ink jet image forming apparatus discharges liquid droplets such as ink droplets onto specific areas of printing medium to print an image on the printing medium. An electrophotographic type image forming apparatus irradiates light onto a photoconductor unit to form an electrostatic latent image on the photoconductor unit, supplies toner having positive or negative polarity to the electrostatic latent image, and then transfers the electrostatic latent image to which the toner has been supplied to printing medium, thereby printing an image on the printing medium.

SUMMARY

In an aspect of one or more embodiments, there is provided an image forming apparatus of reducing image banding that is generated when printing medium collides with a photoconductor unit during printing, and a method of reducing image banding of the image forming apparatus.

In an aspect of one or more embodiments, there is provided an image forming apparatus which includes: a photoconductor unit on which an electrostatic latent image is formed; and a conveying unit configured to convey printing medium at a first conveying velocity toward the photoconductor unit, and configured to convey the printing medium at a second conveying velocity that is lower than the first conveying velocity when the printing medium approaches the photoconductor unit.

The second conveying velocity may be 40% to 70% of the first conveying velocity.

The conveying unit may decrease a conveying velocity of the printing medium from the first conveying velocity to the second conveying velocity according to a predetermined acceleration pattern. The acceleration pattern may be defined by an acceleration function that uses at least one function among a linear function, a polynomial function, a square root function, an exponential function, and a logarithmic function.

The conveying unit may convey the printing medium at a third conveying velocity that is different from the second conveying velocity, and cause the printing medium to enter a nip formed between the photoconductor unit and a transfer unit configured to transfer the electrostatic latent image formed on the photoconductor unit to the printing medium.

The third conveying velocity may be identical to the first conveying velocity.

The conveying unit may decrease a conveying velocity of the printing medium to the second conveying velocity when the printing medium arrives at a deceleration start point. The conveying unit may increase a conveying velocity of the printing medium to a third conveying velocity when the printing medium arrives at an acceleration start point. The deceleration start point may be determined according to the acceleration start point.

The image forming apparatus may further include at least one conveying roller configured to rotate at a first angular velocity to convey the printing medium, and to rotate at a second angular velocity that is different from the first angular velocity, when the printing medium approaches the photoconductor unit.

The image forming apparatus may further include at least one of: a sensing unit configured to detect a position of the printing medium; and a computation unit configured to calculate a position of the printing medium according to a conveying velocity of the printing medium.

In an aspect of one or more embodiments, there is provided an image forming apparatus which includes: a photoconductor unit on which an electrostatic latent image is formed; a transfer unit configured to transfer the electrostatic latent image formed on the photoconductor unit to printing medium; and a conveying unit configured to convey the printing medium to a nip formed between the photoconductor unit and the transfer unit, and configured to change a conveying velocity of the printing medium when the printing medium approaches the nip.

In an aspect of one or more embodiments, there is provided a method of reducing image banding of an image forming apparatus, which includes: conveying printing medium to a photoconductor unit on which an electrostatic latent image is formed, at a first conveying velocity; and conveying the printing medium at a second conveying velocity that is lower than the first conveying velocity, when the printing medium approaches the photoconductor unit.

The second conveying velocity may be 40% to 70% of the first conveying velocity.

The conveying of the printing medium at the second conveying velocity may include decreasing a conveying velocity of the printing medium from the first conveying velocity to the second conveying velocity according to a predetermined acceleration pattern.

The acceleration pattern may be defined by an acceleration function that uses at least one function among a linear function, a polynomial function, a square root function, an exponential function, and a logarithmic function.

The method may further include conveying the printing medium at a third conveying velocity that is different from the second conveying velocity, and causing the printing medium to enter a nip formed between the photoconductor unit and a transfer unit configured to transfer the electrostatic latent image formed on the photoconductor unit to the printing medium.

The third conveying velocity may be identical to the first conveying velocity.

The conveying of the printing medium at the second conveying velocity may include decreasing a conveying velocity of the printing medium to the second conveying velocity when the printing medium arrives at a deceleration start point.

The method may further include increasing a conveying velocity of the printing medium to a third conveying velocity when the printing medium arrives at an acceleration start point.

The deceleration start point may be determined according to the acceleration start point.

The conveying of the printing medium at the second conveying velocity may be performed by at least one conveying roller configured to rotate at a first angular velocity to convey the printing medium, and to rotate at a second angular velocity that is different from the first angular velocity, when the printing medium approaches the photoconductor unit.

The method may further include at least one of: detecting an approach of the printing medium to the photoconductor unit; and determining whether the printing medium approaches the photoconductor unit, based on a conveying velocity of the printing medium.

According to an image forming apparatus and a method of reducing image banding of the image forming apparatus, as described above, since image banding that is generated when printing medium collides with a photoconductor unit during printing can be reduced, the quality of images that are printed on printing medium can be improved. In addition, since image banding can be reduced without adding a new element to the image forming apparatus, it is possible to simplify a design of the image forming apparatus, resulting in preventing a manufacturing cost from rising.

In an aspect of one or more embodiments, there is provided an image forming apparatus which includes a conveying unit configured to convey a printing medium to a nip formed between a photoconductor unit and a transfer unit, configured to change a conveying velocity of the printing medium when the printing medium approaches the nip, and configured to cause the conveying velocity of the printing medium entering the nip to be different from the conveying velocity of the printing medium when the printing medium is approaching the nip.

In an aspect of one or more embodiments, there is provided an image forming apparatus which includes a conveying unit configured to convey printing medium at a first conveying velocity toward a photoconductor unit, configured to convey the printing medium at a second conveying velocity that is lower than the first conveying velocity when the printing medium approaches the photoconductor unit, configured to convey the printing medium at a third conveying velocity that is different from the second conveying velocity, and configured to cause the printing medium to enter a nip formed between the photoconductor unit and a transfer unit.

The third conveying velocity is identical to the first conveying velocity.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
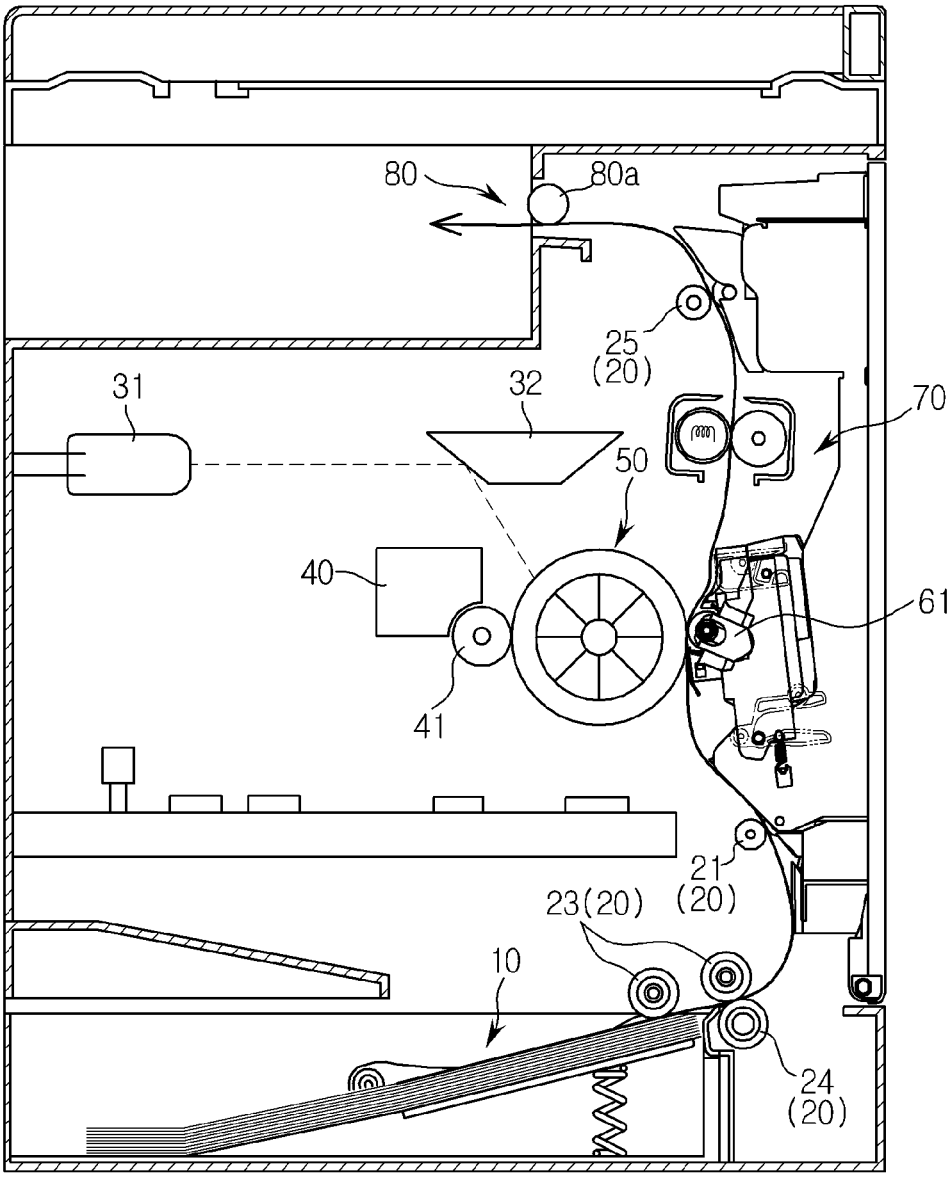
FIG. 1 illustrates an internal structure of an image forming apparatus according to an embodiment of the present disclosure.

Reference will now be made in detail to embodiments of the present disclosure, examples of which are illustrated in the accompanying drawings, wherein like reference numerals refer to like elements throughout.

Hereinafter, an image forming apparatus according to an embodiment of the present disclosure will be described with reference to FIGS. 1 to 14.

Figure 2:
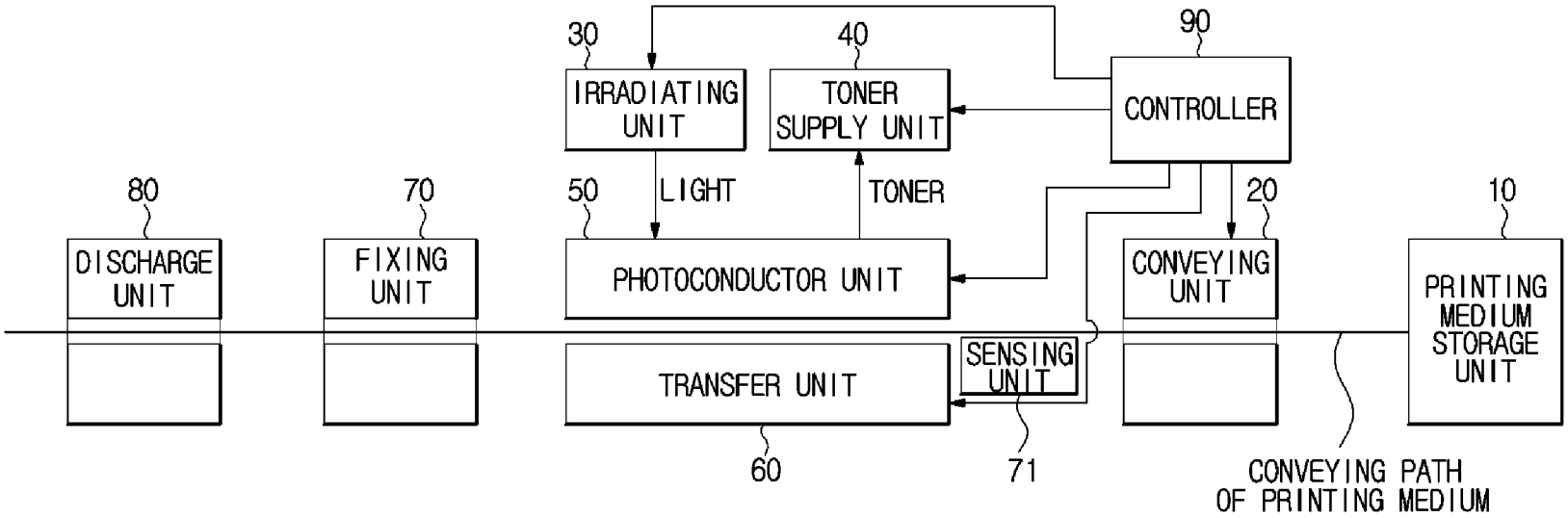
FIG. 2 is a block diagram illustrating a configuration of an image forming apparatus according to an embodiment of the present disclosure.

FIG. 1 illustrates an internal structure of an image forming apparatus according to an embodiment of the present disclosure, and FIG. 2 is a block diagram illustrating a configuration of an image forming apparatus according to an embodiment of the present disclosure.

Referring to FIGS. 1 and 2, an image forming apparatus may include a printing medium storage unit 10, a conveying unit 20, an irradiating unit 30, a toner supply unit 40, a photoconductor unit 50, a transfer unit 60, a fixing unit 70, a discharge unit 80, and a controller 90.

The printing medium storage unit 10 may accommodate at least one printing medium on which an image is to be formed. When the imaging forming apparatus starts printing, the printing medium storage unit 10 may feed printing medium to the image forming apparatus so that the image forming apparatus can print a predetermined image on the printing medium.

The image forming apparatus may include a single printing medium storage unit 10, as illustrated in FIG. 1, or a plurality of printing medium storage units 10. However, the image forming apparatus may include no printing medium storage unit 10. In this case, the image forming apparatus may further include a paper feeder to receive a printing medium such as a printing paper from a user. The paper feeder may include a storage element on which printing medium is placed, and at least one inserting element (e.g., a roller) to insert printing medium placed on the storage element into the image forming apparatus. The printing medium that is stored in the printing medium storage unit 10 may include various kinds of media on which an image can be printed. For example, the printing medium may be a printing paper made with chemical pulp. Also, the printing medium may include various kinds of media having transparency or reflexibility. For example, the printing medium may be a film or a coated paper.

The conveying unit 20 may convey the printing medium stored in the printing medium storage unit 10 to the photoconductor unit 50. According to an embodiment, the conveying unit 20 may include one or more conveying rollers 21 to 25, as illustrated in FIG. 1. The conveying rollers 21 to 25 may convey the printing medium along a predetermined conveying path using a rotational force and a frictional force of rollers. Also, the conveying unit 20 may further include various kinds of guide devices so that the printing medium can be properly conveyed. The guide devices may be guide air ducts.

According to an embodiment, the conveying unit 20 may convey the printing medium at various conveying velocities. If the conveying unit 20 includes one or more conveying rollers 21 to 25, a conveying velocity of the printing medium may be determined by a rotating angular velocity of the conveying rollers 21 to 25. If the rotating angular velocity of the conveying rollers 21 to 25 changes, the conveying velocity of the printing medium that is conveyed by the conveying rollers 21 to 25 may also change to a conveying velocity corresponding to the rotating angular velocity. For example, the conveying rollers 21 to 25 may convey the printing medium at a predetermined conveying velocity while rotating at a predetermined rotating angular velocity, and change the rotating angular velocity when the printing medium arrives at a predetermined location to change the conveying velocity of the printing medium. The printing medium may be conveyed at the changed conveying velocity from when it has passed the predetermined location.

The conveying rollers 21 to 25 of the conveying unit 20 may include a first roller 21 to make printing medium approach the photoconductor unit 50, second rollers 23 and 24 to feed the printing medium, and a third roller 25 to convey printing medium on which an image has been printed to a discharge unit 80.

The first roller 21 may convey the printing medium toward the photoconductor unit 50 so that the printing medium can enter a nip formed between the photoconductor unit 50 and the transfer unit 60, as illustrated in FIG. 1. The first roller 21 may be a regi-roller. According to an embodiment, a rotating angular velocity of the first roller 21 may change as necessary. The second rollers 23 and 24 may pick up printing medium from the printing medium storage unit 10, and locate the printing medium on a predetermined conveying path. The third roller 25 may convey printing medium on which an image has been printed toward the discharge unit 80.

In FIG. 1, for convenience of description, several conveying rollers of the conveying unit 20 have been shown, however, a more number of various kinds of conveying rollers than those shown in FIG. 1 may be installed in the image forming apparatus in order to convey printing medium.

The irradiating unit 30 may irradiate light to the photoconductor unit 50 in order to print an image on printing medium. In detail, the irradiating unit 30 may include a light irradiator 31 to irradiate light such as laser, and a mirror 32 to reflect light irradiated from the light irradiator 31 so as for the light to arrive at a predetermined location of the photoconductor unit 50 charged to a predetermined potential.

The light irradiator 31 may irradiate predetermined light to the mirror 32 or the photoconductor unit 50. The predetermined light may be laser.

The mirror 32 may reflect light irradiated from the light irradiator 31 according to a predetermined control signal so as for the light to arrive at the photoconductor unit 50. The mirror 32 may move or rotate such that reflected light can arrive at a predetermined location of the photoconductor unit 50. According to an embodiment, the mirror 32 may be a polygon prism.

The toner supply unit 40 may store toner that is supplied to the photoconductor unit 50 using roller 41. The toner stored in the toner supply unit 40 may have been charged with positive (+) or negative (−) charges. If a positive- or negative-charged electrostatic latent image is formed on the photoconductor unit 50, the toner charged with negative or positive charges may be adhered onto the electrostatic latent image to form a predetermined image.

An electrostatic latent image may be formed on the surface of the photoconductor unit 50 according to light irradiated to the photoconductor unit 50. An example of a process in which an electrostatic latent image is formed on the surface of the photoconductor unit 50 is as follows. First, a predetermined voltage may be applied to the photoconductor unit 50 so that a negative or positive surface potential is formed on the surface of the photoconductor unit 50 (charging step). If light such as laser is irradiated from the light irradiator 31, the light may arrive at the surface of the photoconductor unit 50 on which a surface potential has been formed. A transmission path of the light may be adjusted by the mirror 32 that reflects light. If the light is incident onto the surface of the photoconductor unit 50, a surface potential of an area of the photoconductor unit 50, onto which the light has been irradiated, may be decayed so that a predetermined print pattern, that is, an electrostatic latent image is formed on the surface of the photoconductor unit 50. The electrostatic latent image is formed on an area of the photoconductor unit 50, changed to polarity that is opposite to the polarity of the photoconductor unit 50 initialized in the charging step (exposure step). Toner having polarity opposite to that of the electrostatic latent image may be supplied from the toner supply unit 40 to the area on which the electrostatic latent image has been formed, and the supplied toner may be adhered onto the area of the photoconductor unit 50 on which the electrostatic latent image has been formed. As a result, an image to be printed may be formed on the surface of the photoconductor unit 50 (developing step).

According to an embodiment, the photoconductor unit 50 may be a photoconductor drum, more specifically, an Organic Photo Conductor (OPC) drum. The OPC drum is a cylindrical photoconductor device in which an OPC material is coated on the surface of an aluminum tube. The OPC drum may form an electrostatic latent image by irradiating light on a surface charged with negative charges to charge an area on which an image is to be formed with positive charges, when the image forming apparatus prints the image on printing medium.

The transfer unit 60 may transfer the electrostatic latent image formed on the photoconductor unit 50 to the printing medium conveyed by the conveying unit 20. The transfer unit 60 may include a transfer roller 61, as illustrated in FIG.

1. A nip which is a space which printing medium can enter may be formed between the transfer roller 61 and the photoconductor unit 50 (e.g., a photoconductor drum). As described above, printing medium may enter the nip formed between the photoconductor unit 50 and the transfer roller 61. If printing medium enters the nip, the image formed on the photoconductor unit 50 may be transferred to the printing medium by a compressive force between the photoconductor unit 50 and the transfer roller 61.

The fixing unit 70 may fix the image transferred to the printing medium. According to an embodiment, the fixing unit 70 may fix the image transferred to the printing medium onto the printing medium by heating the printing medium to which the image has been transferred to compress toner onto the printing medium. The printing medium to which the image has been transferred may be conveyed toward the discharge unit 80 by the third roller 25 of the conveying unit 20.

The discharge unit 80 may discharge the printing medium on which the image has been printed to the outside. The discharge unit 80 may include a predetermined outlet. A discharge roller 80*a* may be disposed around the outlet in order to support discharge of printing medium.

According to an embodiment, the image forming apparatus may include a sensing unit 71 for detecting a position of printing medium. The sensing unit 71 may detect a position of printing medium using light or a weight of the printing medium. The sensing unit 71 may be an optical sensor, such as a visible light sensor or an irradiated sensor, or a mass sensor.

The controller 90 may control overall operations of the image forming apparatus. For example, the controller 90 may generate predetermined control signals, and transfer the predetermined control signals to the light irradiator 31, the mirror 32, the toner supply unit 40, the photoconductor unit 50, and the transfer unit 60, respectively, thereby controlling operations of the light irradiator 31, the mirror 32, the toner supply unit 40, the photoconductor unit 50, and the transfer unit 60.

The controller 90 may be a processor such as a Central Processing Unit (CPU). The processor may be implemented as at least one semiconductor chip or at least one semiconductor memory. The semiconductor chip or the semiconductor memory may be mounted on a Printed Circuit Board (PCB).

According to an embodiment, the controller 90 may control a conveying velocity of printing medium. For example, the controller 90 may transfer a predetermined control signal to the conveying unit 20 so as to convey printing medium at a first conveying velocity, or to change a conveying velocity of printing medium. In order to control the conveying velocity of printing medium, the controller 90 may control rotation velocities of the conveying rollers 21 to 25 of the conveying unit 20. For example, the controller 90 may generate a control signal for changing a rotating angular velocity of the first roller 21 from a first angular velocity to a second angular velocity, and transfer the control signal to the first roller 21. As another example, the controller 90 may generate a control signal for changing a rotating angular velocity of the first roller 21 from the second angular velocity to a third angular velocity, and transfer the control signal to the first roller 21. Also, the controller 90 may control changes in angular velocity, that is, changes in angular acceleration of the conveying rollers 21 to 25 of the conveying unit 20. For example, the controller 90 may generate a control signal for reducing an angular velocity of the first roller 21 from the first angular velocity to the second angular velocity according to fixed angular acceleration, and transfer the control signal to the first roller 21.

Hereinafter, image bending of the imaging forming apparatus will be described with reference to FIGS. 3, 4, and 5.

Figure 3:
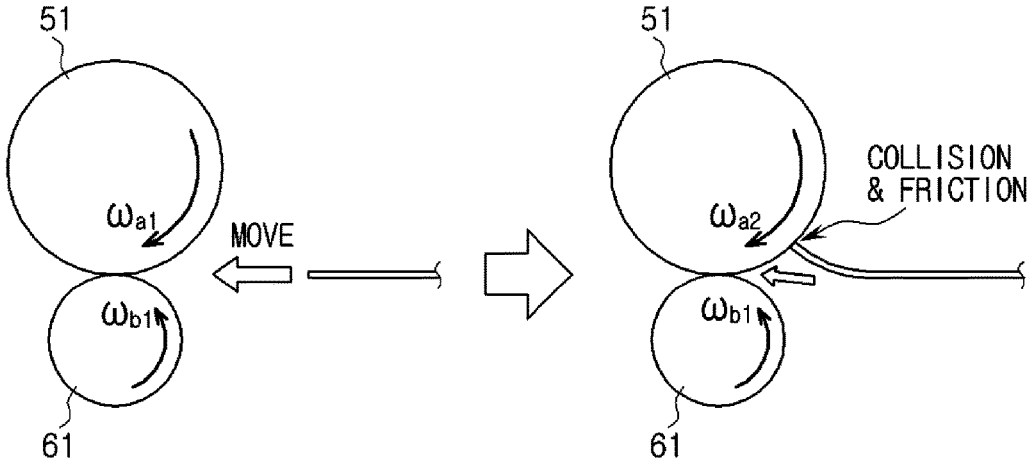
FIG. 3 is a view for describing an operation in which printing medium approaches and enters a nip.

FIG. 3 is a view for describing an operation in which printing medium approaches and enters a nip.

As illustrated in FIG. 3, the photoconductor drum 51 of the photoconductor unit 50 may rotate at a first photoconductor drum angular velocity ωa1, and the transfer roller 61 of the transfer unit 60 may rotate at a transfer unit angular velocity ωb1 corresponding to the first photoconductor drum angular velocity ωa1 of the photoconductor drum 51. The photoconductor drum 51 and the transfer roller 61 may rotate in opposite directions. When printing medium approaches a nip formed between the photoconductor drum 51 and the transfer roller 61, the printing medium may first contact the photoconductor drum 51, and then enter the nip according to rotation of the photoconductor drum 51. In this case, due to an impulse caused by collision with the printing medium and a change in load caused by a friction force between the photoconductor drum 51 and the printing medium, an angular velocity of the photoconductor drum 51 may change. Accordingly, the photoconductor drum 51 may rotate at a second photoconductor drum angular velocity ωa2 that is different from the first photoconductor drum angular velocity ωa1.

Figure 4:
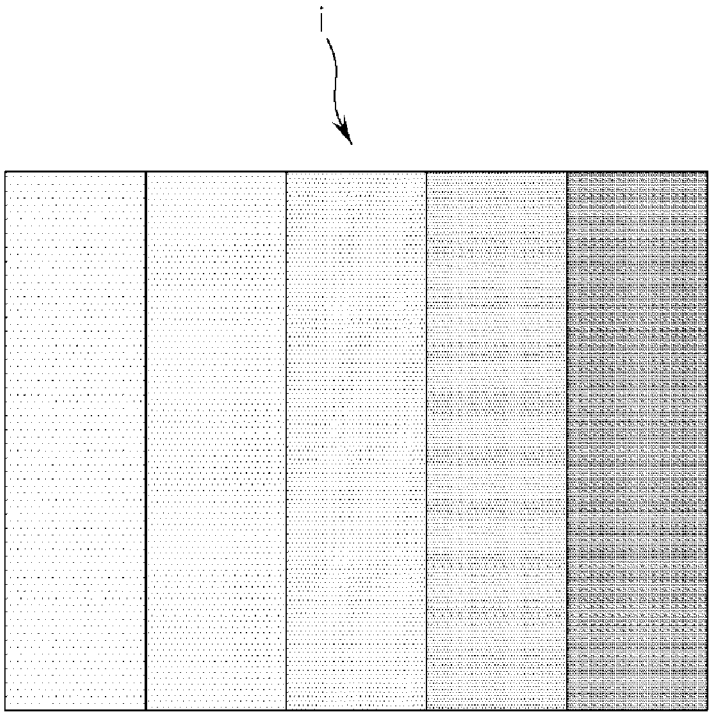
FIG. 4 shows an example of an image printed on printing medium when no image banding has occurred.
Figure 5:
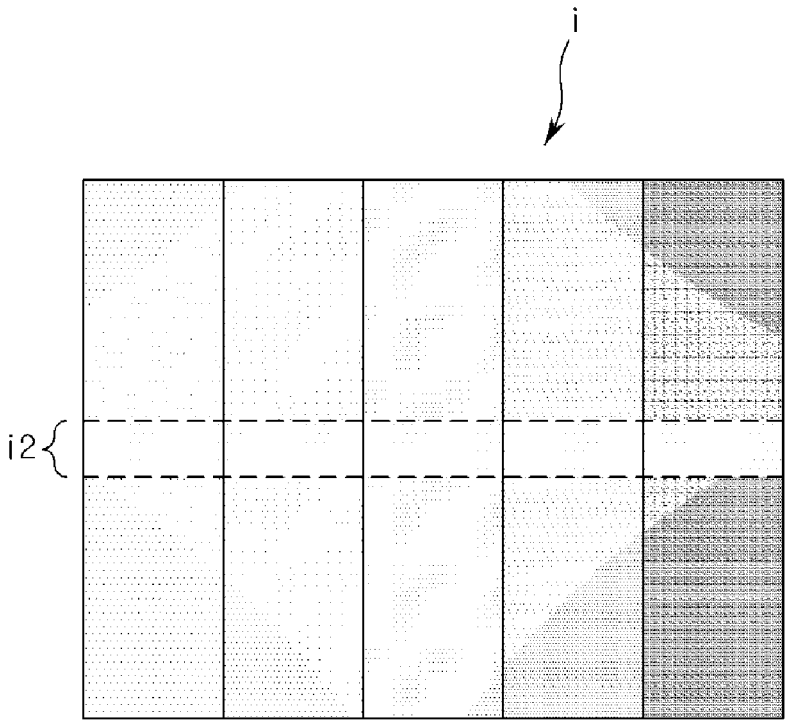
FIG. 5 shows an example of an image printed on printing medium when image banding has occurred.

FIGS. 4 and 5 show examples of images printed on printing medium when no image banding has occurred and when image banding has occurred, respectively. In FIGS. 4 and 5, images i including a plurality of color bands arranged in a row are shown. Each image i is printed by transferring toner of different colors to printing medium while the printing medium moves in a up or down direction as seen from the corresponding drawing.

If an angular velocity of the photoconductor drum 51 does not change, an exposure density on the surface of the photoconductor drum 51 can be maintained as a desired exposure density. Accordingly, in this case, an ideal image i as shown in FIG. 4 can be printed on printing medium. For example, since an exposure density on the surface of the photoconductor drum 51 can be maintained uniform when the angular velocity of the photoconductor drum 51 does not change, the densities of color bands printed on printing medium also can be maintained uniform.

However, if the angular velocity of the photoconductor drum 51 changes as described above with reference to FIG. 3, an exposure density on the surface of the photoconductor drum 51 may change since operations of the light irradiator 31 and the mirror 32 do not change. A change in exposure density on the surface of the photoconductor drum 51 may cause image banding as shown in FIG. 5. The image banding refers to a phenomenon in which a blurred area i2 is made in the form of a band in an image i. The image banding deteriorates the printing quality of the image forming apparatus.

According to an embodiment, the conveying unit 20 of the image forming apparatus may change a conveying velocity of printing medium that is conveyed toward the photoconductor drum 50 in order to prevent image banding.

Figure 6:
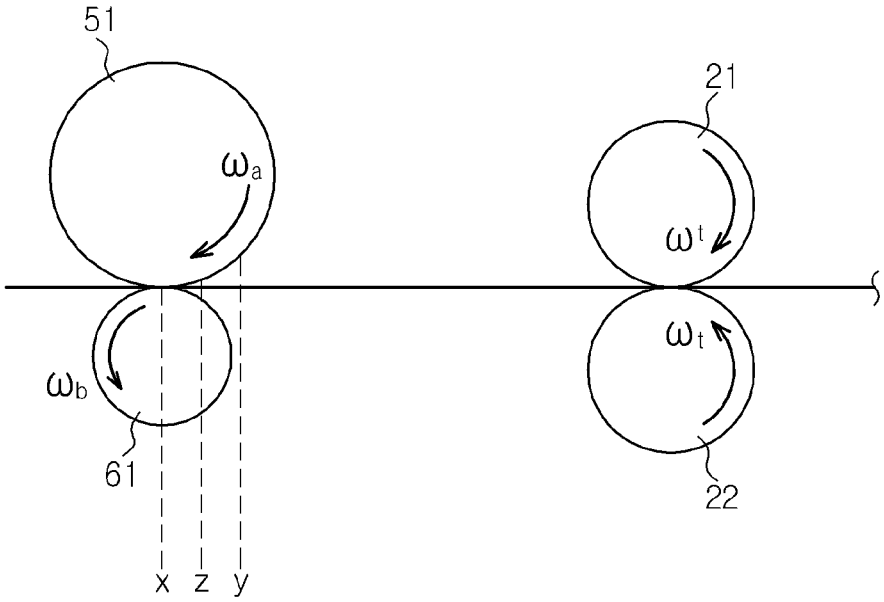
FIG. 6 is a view for describing a method of controlling a conveying velocity of printing medium, according to an embodiment of the present disclosure.

FIG. 6 is a view for describing a method of controlling a conveying velocity of printing medium, according to an embodiment of the present disclosure.

As illustrated in FIG. 6, printing medium may be conveyed by the first rollers 21 and 22, and approach the photoconductor drum 51 of the photoconductor unit 50. The transfer roller 61 of the transfer unit 60 may be disposed adjacent to the photoconductor drum 51 of the photoconductor unit 50 while being spaced by a predetermined distance apart from the photoconductor drum 51 of the photoconductor unit 50.

The photoconductor drum 51 may rotate at a first photoconductor drum angular velocity ωa, and the transfer roller 61 may rotate at a transfer roller angular velocity ωb. The first photoconductor drum angular velocity ωa may be identical to or different from the transfer roller angular velocity ωb. A nip x which printing medium enters and at which an electrostatic latent image is transferred to the printing medium may be formed between the photoconductor drum 51 and the transfer roller 61.

One or more points at which the conveying velocity of printing medium changes may exist around the photoconductor drum 51. The one or more points at which the conveying velocity of printing medium changes may be a deceleration start point y and an acceleration start point z. The deceleration start point y and the acceleration start point z may be located between the photoconductor drum 51 and the first rollers 21 and 22. The deceleration start point y may be more distant from the photoconductor drum 51 and closer to the first rollers 21 and 22, than the acceleration start point z. The acceleration start point z may be located between the deceleration start point y and the nip x.

According to an embodiment, the deceleration start point y may be determined as a point from which a distance to the photoconductor drum 51 or the nip x is within a predetermined range. For example, in an image forming apparatus having a predetermined size, a deceleration start point y may be at one of distances from 10 mm to 12 mm away from the photoconductor drum 51 or the nip x in the direction toward the first rollers 21 and 22.

According to an embodiment, the deceleration start point y may be determined depending on the acceleration start point z. More specifically, a distance between the deceleration start point y and the photoconductor drum 51 or the nip x may be determined depending on a distance between the acceleration start point z and the photoconductor drum 51 or the nip x. For example, in an image forming apparatus having a predetermined size, a distance dy between a deceleration start point y and a nip x may be determined depending on a relationship between the distance dy between the deceleration start point y and the nip x and a distance dz between an acceleration start point z and the nip x, which can be given by Equation (1).

$$0<d_y-d_z\leq 2 \quad (1)$$

where dy is a distance between the deceleration start point y and the photoconductor drum 51 or the nip x, and dz is a distance between the acceleration start point z and the photoconductor drum 51 or the nip x. In Equation (1), the unit of each constant is millimeters (mm). According to an embodiment, the distance dz between the acceleration start point z and the photoconductor drum 51 or the nip x may be longer than 10 mm.

According to an embodiment, the acceleration start point z may be determined as an arbitrary point as long as the distance dz between the acceleration start point z and the photoconductor drum 51 or the nip x is within a predetermined range. For example, in an image forming apparatus having a predetermined size, an acceleration start point z may be at one of distances from 10 mm to 60 mm away from the photoconductor drum 51 or the nip x in the direction toward the first rollers 21 and 22. For example, the acceleration start point z may be at a distance of 60 mm away from the photoconductor drum 51 or the nip x in the direction toward the first rollers 21 and 22.

The first rollers 21 and 22 may rotate at a predetermined conveying angular velocity ωt. According to an embodiment, a plurality of first rollers 21 and 22 may be provided in pairs to convey printing medium, as illustrated in FIG. 6. However, a single first roller 21 or 22 may be provided to convey printing medium. If the first rollers 21 and 22 rotate at a predetermined conveying angular velocity ωt, printing medium may be conveyed at a velocity v corresponding to the predetermined conveying angular velocity ωt. In this case, the velocity v may be determined in proportion to a multiple of the conveying angular velocity ωt of the first rollers 21 and 22 and the radius of the first rollers 21 and 22 when there is no energy loss. However, since energy loss may occur in reality, the conveying angular speed wt of the first rollers 21 and 22 can be adjusted according to a required conveying velocity v in consideration of the properties of the first rollers 21 and 22 or a kind of printing medium (e.g., a thickness or a friction force of printing medium).

If the conveying angular velocity ωt of the first rollers 21 and 22 changes, the conveying velocity v of the printing medium also changes so that the conveying velocity v of the printing medium can be adjusted. The first rollers 21 and 22 may rotate at a lower conveying angular velocity ωt in order to decrease the conveying velocity v of printing medium, and the first rollers 21 and 22 may rotate at a higher conveying angular velocity ωt in order to increase the conveying velocity v of printing medium. The velocity of the first rollers 21 and 22 may be controlled by the controller 90.

Figure 7:
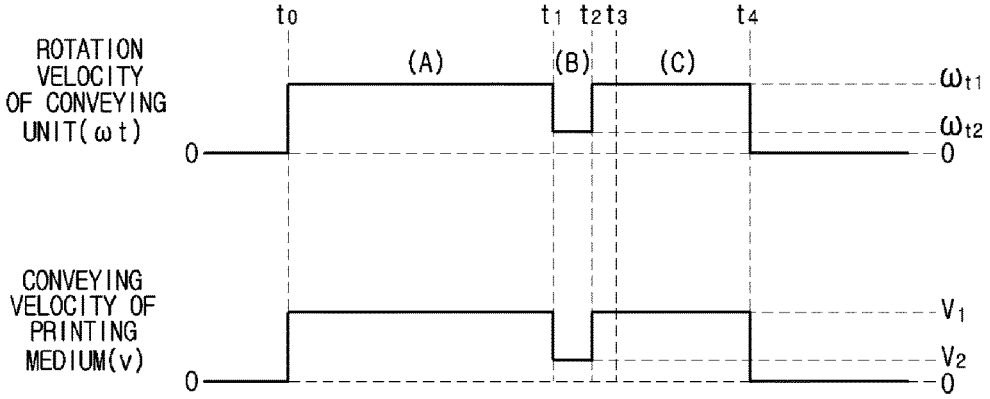
FIG. 7 is a graph showing changes in rotation velocity of a conveying unit and changes in conveying velocity of printing medium, which are controlled according to an embodiment of a method of controlling a conveying velocity of printing medium.

FIG. 7 is a graph showing changes in rotation velocity of the conveying unit 20 and changes in conveying velocity of printing medium, which are controlled according to an embodiment of a method of controlling a conveying velocity of printing medium, and FIGS. 8 to 11 are views for describing an operation in which printing medium approaches the photoconductor unit 50.

Referring to FIGS. 1 and 7, the conveying unit 20, for example, the first rollers 21 and 22 may rotate at a first conveying angular velocity ωt1 during a time period from a conveying start time t0 to a first conveying time t1, rotate at a second conveying angular velocity ωt2 during a time period from the first conveying time t1 to a second conveying time t2, and rotate at a third conveying angular velocity (e.g., the first conveying angular velocity ωt1) during a time period from the second conveying time t2 to a conveying end time t4. A conveying velocity v of printing medium may change to correspond to the conveying angular velocity ωt of the conveying unit 20.

Hereinafter, changes in conveying velocity of printing medium will be described in more detail.

Referring to FIGS. 1 and 7, the conveying unit 20, for example, the first rollers 21 and 22 may start rotating at the first conveying angular velocity ωt1 at the conveying start time t0. Then, printing medium contacting the first rollers 21 and 22 also starts being conveyed at a first conveying velocity v1 by a friction force between the first rollers 51 and 52 and the printing medium and a rotational force of the first rollers 21 and 22. While the first rollers 51 and 52 rotate at the first conveying angular velocity ωt1, the printing medium may be conveyed at the first conveying velocity v1 (a period (A) of FIG. 7). According to an embodiment, the first conveying velocity v1 may depend on rotating angular velocities ωa and ωb of the photoconductor drum 51 and the transfer roller 61 (see FIG. 6).

The printing medium may arrive at a predetermined point, for example, a deceleration start point y at the first conveying time t1. According to an embodiment, whether the printing medium has arrived at the predetermined point may be determined depending on whether the sensing unit 71 (see FIG. 2) has detected printing medium. Also, a position of the printing medium may be calculated according to a conveying velocity of the printing medium or according to a rotation velocity of the first rollers 21 and 22 of the conveying unit 20. A position of the printing medium may be calculated by a predetermined computation unit. The predetermined computation unit may be a CPU.

Figure 8:
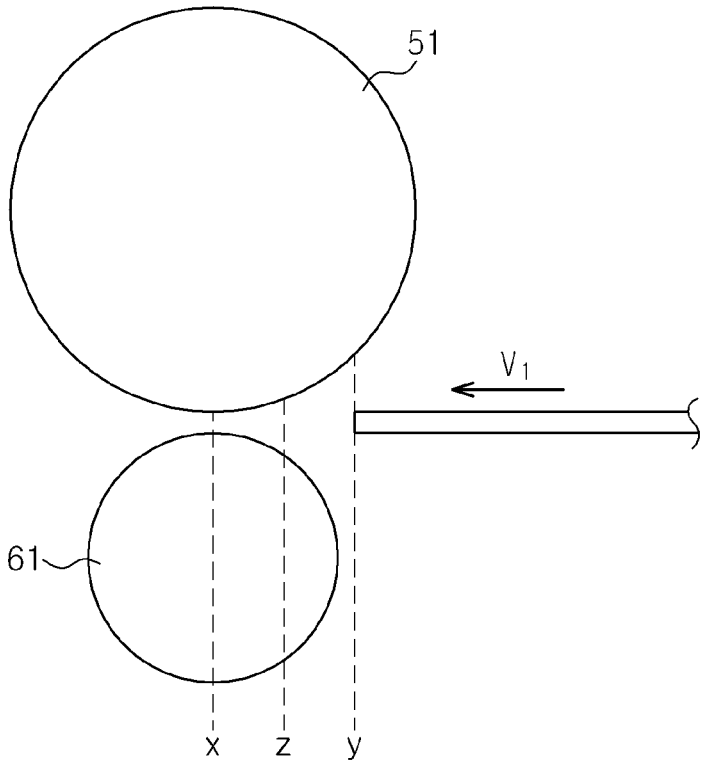
FIGS. 8 to 11 are views for describing an operation in which printing medium approaches a photoconductor unit.
Figure 9:
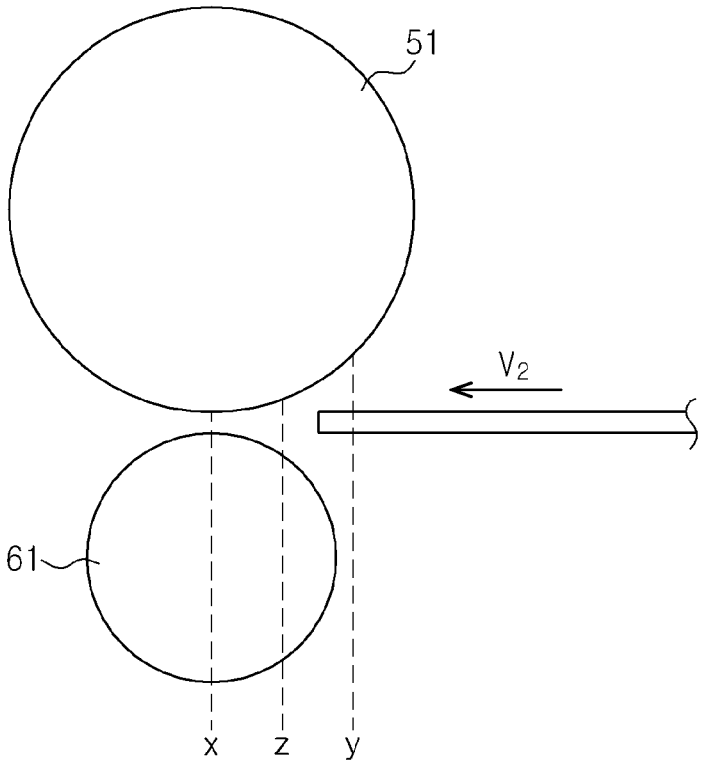

As illustrated in FIG. 8, when the printing medium arrives at the predetermined point, for example, the deceleration start point y, the first rollers 21 and 22 may rotate at a second conveying angular velocity ωt2. Then, the conveying velocity of the printing medium changes according to the change in rotation velocity of the first rollers 21 and 22, so that the printing medium is conveyed at the second conveying velocity v2 (a period (B) of FIG. 7). The second conveying angular velocity ωt2 may be lower than the first conveying angular velocity ωt1. According to an embodiment, the second conveying velocity v2 of the printing medium may be 40% to 70% of the first conveying velocity v1. That is, the first conveying velocity v1 and the second conveying velocity v2 may be expressed by Equation (2) below.

$$0.4 \le \frac{v_2}{v_1} \le 0.7 \tag{2}$$

As a result, the printing medium may approach the photoconductor drum 51 at the second conveying velocity v2 that is lower than the first conveying velocity v1, in an area between the deceleration start point y and the photoconductor drum 51.

Figure 10:
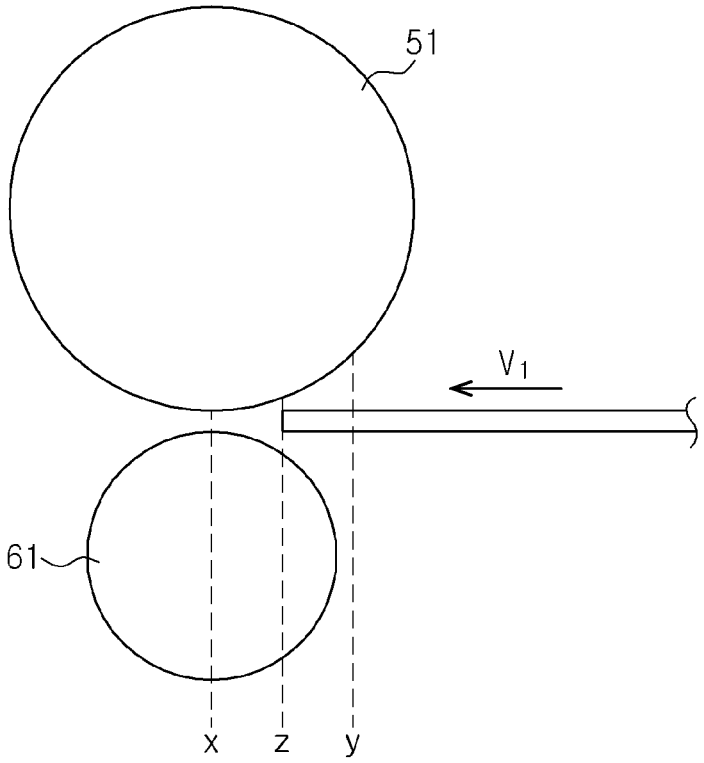

Successively, the printing medium may arrive at a predetermined point, for example, an acceleration start point z at the second conveying time t2. As illustrated in FIG. 10, if the printing medium arrives at a predetermined point, for example, an acceleration start point z, the first rollers 21 and 22 may rotate at a third conveying angular velocity. If the rotation velocity of the first rollers 21 and 22 changes, the conveying velocity of the printing medium may also change to correspond to the change in rotation velocity of the first rollers 21 and 22. As a result, the printing medium may be conveyed at the third conveying velocity corresponding to the third conveying angular velocity (a period (C) of FIG. 7). The printing medium may enter the nip x at a time t3. Accordingly, the printing medium approaches the photoconductor drum 51 at the third conveying velocity in an area between the acceleration start point z and the photoconductor drum 51 or the nip x, and enter the nip x at the third conveying velocity. If the printing medium enters the nip x, an electrostatic latent image may be transferred to the printing medium.

Since the printing medium enters the nip x at the third conveying velocity, the third conveying velocity may be set to a velocity at which an electrostatic latent image can be transferred to the printing medium. Accordingly, the third conveying velocity may be decided depending on the rotating angular velocities ωa and ωb of the photoconductor drum 51 and the transfer roller 61.

Figure 11:
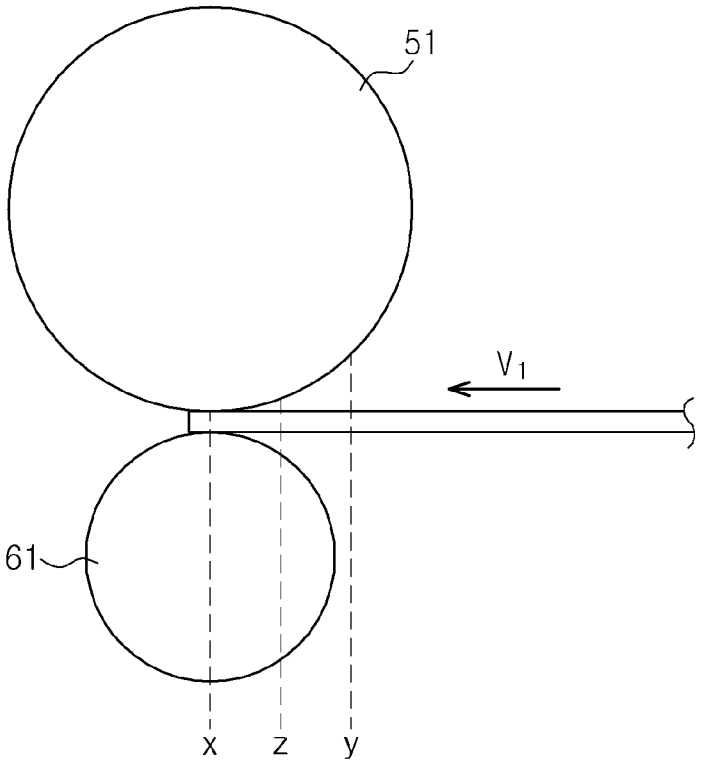

According to an embodiment, the third conveying angular velocity may be identical to the first conveying angular velocity ωt1, as shown in FIG. 7. However, the third conveying angular velocity may be different from the first conveying angular velocity ωt1. That is, the third conveying velocity may be identical to or different from the first conveying velocity v1, as shown in FIGS. 7 and 10. If the third conveying velocity is identical to the first conveying velocity v1, the printing medium can approach the photoconductor drum 51 at the same velocity as the first conveying speed v1 in the area between the acceleration start point z and the photoconductor drum 51 or the nip x, as illustrated in FIG. 10. That is, the printing medium may enter the nip x at the first conveying velocity v1 which is the conveying velocity of the printing medium before the conveying velocity of the printing medium changes, as illustrated in FIG. 11.

If printing terminates, the conveying unit 20, for example, the first rollers 21 and 22 may stop rotating at the conveying end time t4, and accordingly, printing medium may be no longer conveyed.

The rotating angular velocity of the conveying unit 20 and the conveying velocity of the printing medium may be controlled by the controller 80.

Figure 12:
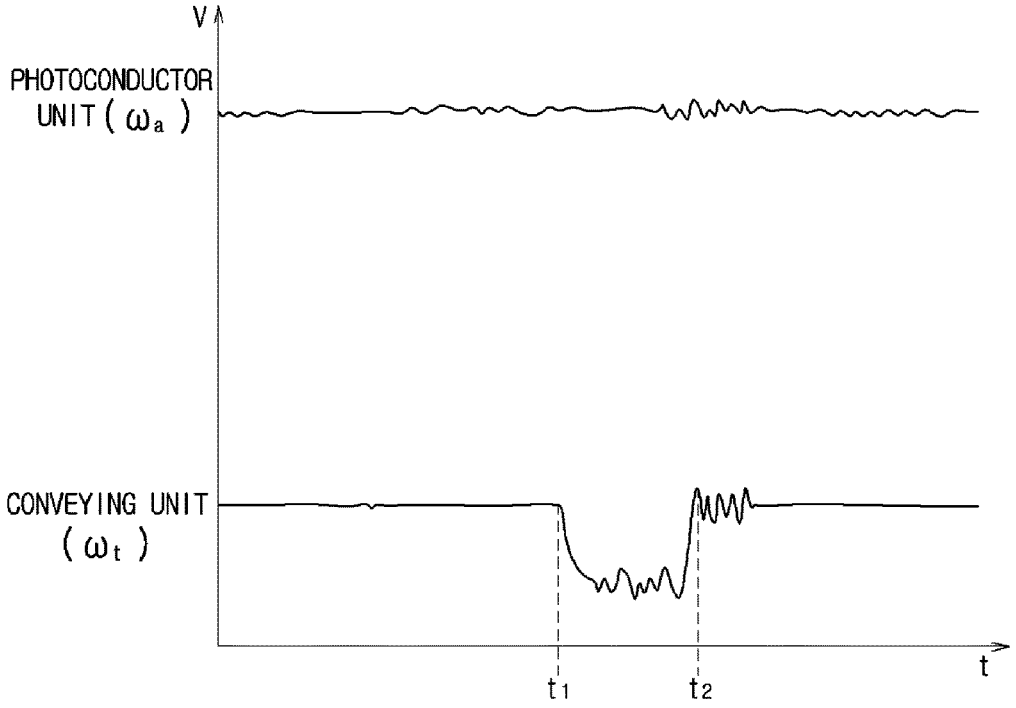
FIG. 12 is a graph showing changes in rotation velocity of a photoconductor unit according to changes in rotation velocity of a conveying unit and changes in conveying velocity of printing medium.

FIG. 12 is a graph showing changes in rotation velocity of the photoconductor unit 20 according to changes in rotation velocity of the conveying unit 20 and changes in conveying velocity of printing medium. FIG. 12 shows the measurement results of rotation velocities of the conveying unit 20 and the photoconductor drum 51 when the conveying unit 20 is a Brushless Direct Current (BLDC) motor, and the photoconductor drum 51 is an OPC drum. In FIG. 12, the x axis represents an elapsed time, and the y axis represents an angular velocity.

As such, if the conveying velocity v of the printing medium decreases when the printing medium approaches the photoconductor unit 50, for example, the photoconductor drum 51, the printing medium does not collide with the photoconductor unit 51, for example, the photoconductor drum 51, or collides with the photoconductor unit 50, for example, the photoconductor drum 51 with a relatively weak impulse. Accordingly, the photoconductor drum 51 has no change or a minimum change in angular velocity. As shown in FIG. 12, the angular velocity ωa of the photoconductor drum 51 of the photoconductor unit 50 is maintained nearly uniform although the angular velocity ωt of the conveying unit 20 changes during the time period from the first conveying time t1 and the second conveying time t2.

As a result, since an exposure density on the surface of the photoconductor drum 51 can be maintained as a desired exposure density, an ideal image i as shown in FIG. 4 can be printed on printing medium.

The rotation velocity w and the conveying velocity v of the conveying unit 20 can be controlled by various methods. For example, a rotation velocity of the first rollers 21 and 22 of the conveying unit 20 may decrease from the first conveying angular velocity ωt1 to the second conveying angular velocity ωt2 according to a predetermined acceleration pattern, or may increase from the second conveying angular velocity ωt2 to the third conveying angular velocity according to a predetermined acceleration pattern.

Figure 13:
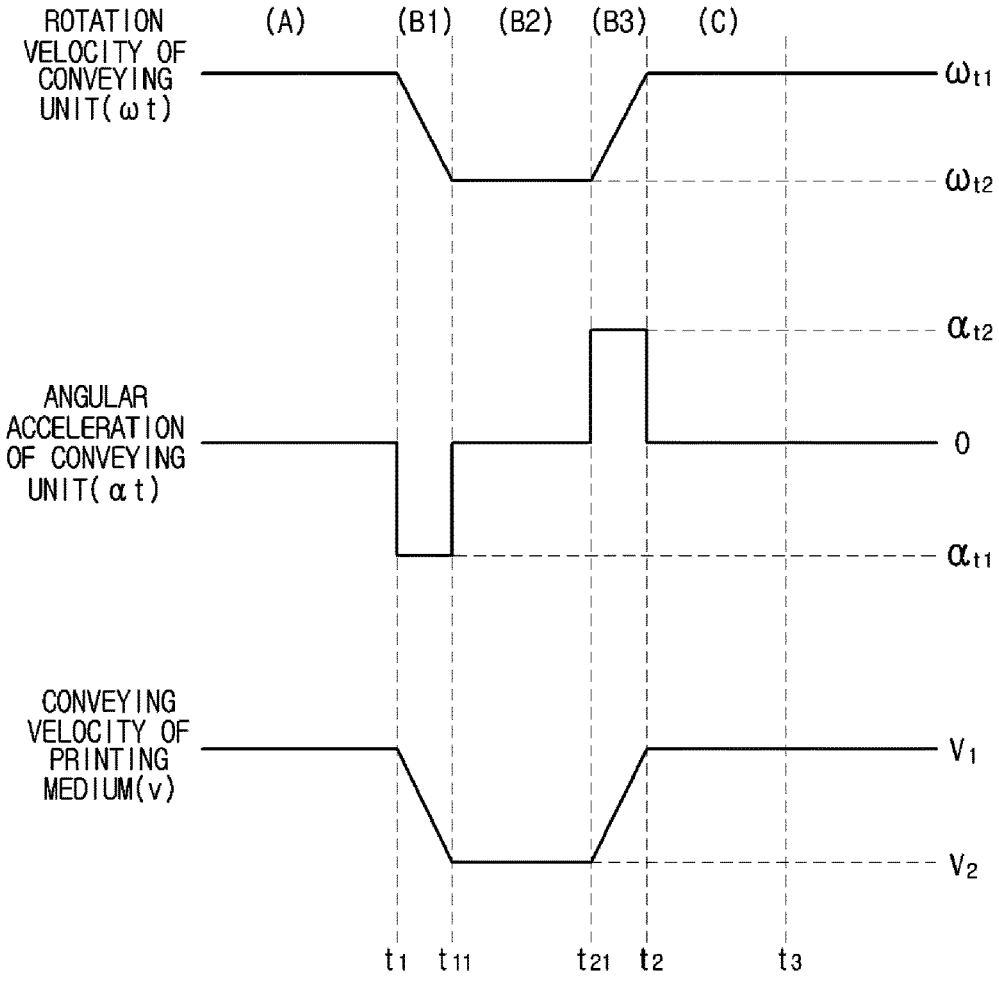
FIG. 13 is a graph showing changes in conveying velocity of printing medium that is controlled according to another embodiment of a method of controlling a conveying velocity of printing medium.

FIG. 13 is a graph showing changes in conveying velocity of printing medium that is controlled according to another embodiment of a method of controlling a conveying velocity of printing medium.

As illustrated in FIG. 13, if printing medium arrives at a deceleration start point, a rotation velocity of the first rollers 21 and 22 of the conveying unit 20 may decrease from a first conveying angular velocity ωt1 to a second conveying angular velocity ωt2 according to a predetermined acceleration pattern, during a time period from t1 to t11 (a period (B1) of FIG. 13). In this case, the rotation velocity of the first rollers 21 and 22 may decrease by first angular acceleration αt1. The first angular acceleration αt1 may not change over time, as shown in FIG. 13. If the conveying unit 20 is a step motor, step out may occur while the velocity of the conveying unit 20 is controlled. In this case, by decreasing the rotation velocity of the first rollers 21 and 22 of the conveying unit 20 at constant angular acceleration $\alpha t1$ during the time period from t1 to t11, step out which may occur while the velocity of the first rollers 21 and 22 is controlled can be prevented.

If the angular velocity of the first rollers 21 and 22 decreases from the first conveying angular velocity $\omega t1$ during the time period from t1 to t11 and reaches the second conveying angular velocity $\omega t2$, the first rollers 21 and 22 may rotate at the second conveying angular velocity $\omega t2$ (a period (B2) of FIG. 13). If the printing medium arrives at an acceleration start point, the rotation velocity of the first rollers 21 and 22 may increase to the third conveying speed v1 at second angular acceleration $\alpha t2$ during a time period from t21 to t2 (a period (B3) of FIG. 13). The second angular acceleration $\alpha t2$ may not change over time, as shown in FIG. 13.

As shown in FIG. 13, the conveying velocity v of the printing medium may change to correspond to a change in angular velocity of the first rollers 21 and 22. For example, the printing medium may be conveyed at the first conveying velocity v1 in the period (A), decelerate in the period (B1), be conveyed at the second conveying velocity v2 in the period (B2), then accelerate in the period (B3), and be conveyed at the first conveying velocity v1 in the period (C). Thereafter, the printing medium may enter the nip at the first conveying velocity v1 at a time t3.

Figure 14:
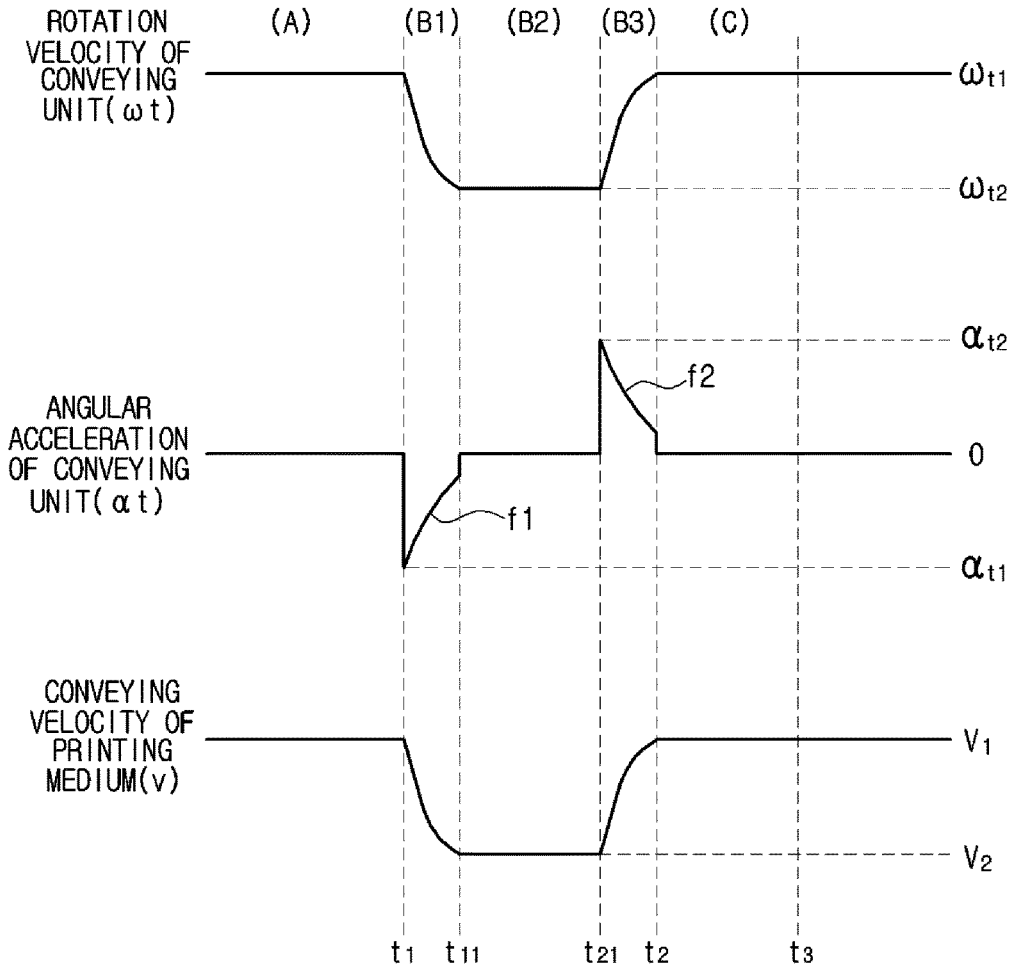
FIG. 14 is a graph showing changes in conveying velocity of printing medium that is controlled according to still another embodiment of a method of controlling a conveying velocity of printing medium.

FIG. 14 is a graph showing changes in conveying velocity of printing medium that is controlled according to still another embodiment of a method of controlling a conveying velocity of printing medium.

An acceleration pattern for decreasing the first conveying angular velocity $\omega t1$ to the second conveying angular velocity $\omega t2$, or an acceleration pattern for increasing the second conveying angular velocity $\omega t2$ to the third conveying angular velocity may be decided in various ways. For example, the acceleration pattern may be defined by an acceleration function that uses at least one function among a linear function, a polynomial function, a square root function, an exponential function, and a logarithmic function.

For example, the acceleration pattern may be a linear acceleration pattern defined by a linear function, as illustrated in FIG. 13. As another example, the acceleration pattern may be an exponential acceleration pattern (f1 or f2) defined by an exponential function, as illustrated in FIG. 14 (a period (B1) or (B3) of FIG. 14). If the acceleration pattern is an exponential acceleration pattern defined by an exponential function, an amount of impulse due to a difference in acceleration can be reduced since the rotation velocity of the conveying unit 20 decreases or increases gently, as shown in FIG. 14. Accordingly, image banding of the image forming apparatus can be further improved.

According to an embodiment, the acceleration pattern (an acceleration pattern corresponding to the period (B1)) for decreasing the first conveying angular velocity $\omega t1$ to the second conveying angular velocity $\omega t2$ may be identical to or different from the acceleration pattern (an acceleration pattern corresponding to the period (B3)) for increasing the second conveying angular velocity $\omega t2$ to the third conveying angular velocity. FIGS. 13 and 14 show cases in which the acceleration patterns are identical to each other. However, the acceleration patterns may be different from each other as necessary. For example, it is possible to decrease the angular velocity of the first rollers 21 and 22 from the first conveying angular velocity $\omega t1$ to the second conveying angular velocity $\omega t2$ at the first angular acceleration $\alpha t1$ that does not change over time (see the period (B1) of FIG. 13), and then to increase the angular velocity of the first rollers 21 and 22 from the second conveying angular velocity $\omega t2$ to the third conveying angular velocity according to an acceleration pattern defined by an exponential function (see the period (B3) of FIG. 14).

An acceleration pattern that is applied to each period may be selected and decided by a system designer or a user using the image forming apparatus.

Hereinafter, a method of reducing image banding of the image forming apparatus, according to an embodiment of the present disclosure, will be described with reference to FIG. 15.

Figure 15:
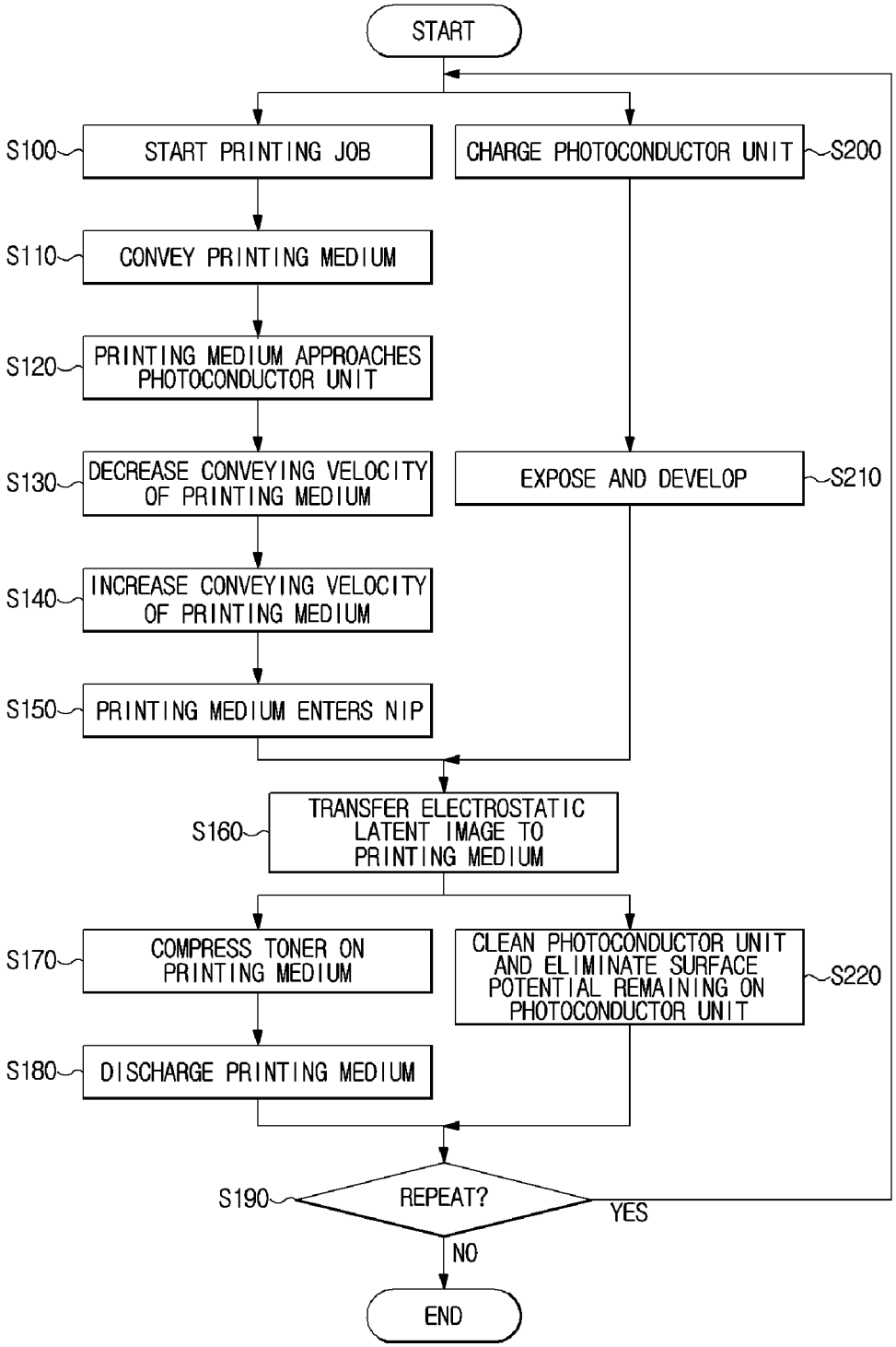
FIG. 15 is a flowchart illustrating a method of reducing image banding of an image forming apparatus, according to an embodiment of the present disclosure.

FIG. 15 is a flowchart illustrating a method of reducing image banding of an image forming apparatus, according to an embodiment of the present disclosure.

As illustrated in FIGS. 1 and 15, if a printing job starts (S100), printing medium may start being conveyed from the printing medium storage unit 10 (S110). When or after the printing medium starts being conveying, the surface of the photoconductor unit 50, for example, the photoconductor drum 51 may be charged (S200). If the surface of the photoconductor unit 50 is charged, exposure and developing may be performed (S210).

The printing medium may approach the photoconductor unit 50 while moving toward the photoconductor unit 50 by the conveying unit 20 (S120).

If the printing medium arrives at a predetermined point, for example, a deceleration start point, the conveying unit 20 may decrease the conveying velocity of the printing medium (S130). In this case, whether the printing medium has arrived at the deceleration start point may be determined depending on whether the sensing unit 71 (see FIG. 2) has detected printing medium, or depending on a conveying velocity v of the printing medium or an angular velocity w of the first rollers 21 and 22 of the conveying unit 20. A conveying velocity of the printing medium may decrease by changing a rotation velocity of the first rollers 21 and 22 of the conveying unit 20. In this case, a rotation velocity of the first rollers 21 and 22 may decrease according to a predetermined acceleration pattern, and a conveying velocity of the printing medium may also decrease to correspond to the rotation velocity of the first rollers 21 and 22. The printing medium may be conveyed at the decreased velocity, for example, a second conveying velocity v2, and the second conveying velocity v2 may be 40% to 70% of a first conveying velocity v1 of the printing medium which is a conveying velocity of the printing medium before the velocity of the printing medium decreases.

As such, since the conveying velocity of printing medium decreases before the printing medium enters a nip formed between the photoconductor unit 50 and the transfer unit 60, the printing medium may not collide with the photoconductor unit 50. Accordingly, it is possible to prevent the velocity of the photoconductor unit 50 from decreasing due to a collision between printing medium and the photoconductor unit 50, resulting in preventing image bending. Even when printing medium collides with the photoconductor unit 50, an amount of impulse can be relatively reduced. Accordingly, it is possible to minimize a reduction in velocity of the photoconductor unit 50, and consequently to maximally block image bending.

If the printing medium arrives at a predetermined point, for example, at an acceleration start point, the conveying unit 20 may increase the conveying velocity of the printing medium (S140). In this case, whether the printing medium has arrived at the acceleration start point may be determined depending on whether the sensing unit 71 (see FIG. 2) has detected printing medium, or depending on the conveying velocity v of the printing medium or the angular velocity w of the first rollers 21 and 22 of the conveying unit 20. A conveying velocity of the printing medium may decrease by changing a rotation velocity of the first rollers 21 and 22 of the conveying unit 20. In this case, a rotation velocity of the first rollers 21 and 22 may increase according to a predetermined acceleration pattern, and a conveying velocity of the printing medium may also increase to correspond to the rotation velocity of the first rollers 21 and 22. The printing medium may be conveyed at the increased velocity, for example, a third conveying velocity, and the third conveying velocity may be identical to the first conveying velocity v1 which is a conveying velocity of the printing medium before the conveying velocity of the printing medium decreases.

The printing medium may enter a nip formed between the photoconductor unit 50 and the transfer unit 60 while moving at the increased velocity (S150).

Before the printing medium enters the nip, an electrostatic latent image may be formed on the surface of the photoconductor unit 50, for example, the photoconductor drum 51 according to an exposure process, and toner may be supplied to the electrostatic latent image to develop the electrostatic latent image (S210). The exposure and developing processes may be performed before the printing medium approaches the photoconductor unit 50 (S120) or after the printing medium has approached the photoconductor unit 50.

If the printing medium enters the nip, the electrostatic latent image in which toner has been supplied on the surface of the photoconductor drum 51 may be transferred to the printing medium (S160). Successively, toner adhered on the printing medium may be compressed by the fixing unit 70, and fixed on the printing medium (S170). The printing medium on which toner has been fixed may be discharged to the outside through the discharge unit 80 (S180).

Before the photoconductor unit 50 may remove toner remaining on the surface of the photoconductor unit 50 through a cleaning process, for another printing job, and eliminate a surface potential remaining on the photoconductor unit 50 through a static elimination process (S220).

The above-described operations S100 to S180 and S200 to S220 may be repeatedly performed while a plurality of printing jobs are printed (S190).

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a photoconductor unit including a photoconductor drum on which an electrostatic latent image is formed;

a transfer unit including a transfer roller to transfer the electrostatic latent image formed on the photoconductor unit to a printing medium, wherein a nip is formed between the photoconductor drum and the transfer roller;

a controller to:

determine an arbitrary point as an acceleration start point, wherein a distance between the arbitrary point and the nip is less than a radius of the photoconductor drum, and determine a deceleration start point that is farther from the nip than the determined acceleration start point based on the determined acceleration start point; and a conveying unit including at least one conveying roller that:

conveys the printing medium at a first conveying velocity toward the determined deceleration start point, conveys the printing medium at a second conveying velocity that is lower than the first conveying velocity from the determined deceleration start point toward the determined acceleration start point, and conveys the printing medium at a third conveying velocity that is different from the second conveying velocity from the determined acceleration start point toward the nip.

2. The image forming apparatus according to claim 1, wherein the second conveying velocity is 40% to 70% of the first conveying velocity.

3. The image forming apparatus according to claim 1, wherein the conveying unit decreases a conveying velocity of the printing medium from the first conveying velocity to the second conveying velocity according to a predetermined acceleration pattern.

4. The image forming apparatus according to claim 3, wherein the acceleration pattern is defined by an acceleration function that uses at least one function among a linear function, a polynomial function, a square root function, an exponential function, and a logarithmic function.

5. The image forming apparatus according to claim 1, wherein the third conveying velocity is identical to the first conveying velocity.

6. The image forming apparatus according to claim 1, wherein the at least one conveying roller configured to rotate at a first angular velocity to convey the printing medium, and configured to rotate at a second angular velocity that is different from the first angular velocity, when the printing medium approaches the photoconductor unit.

7. The image forming apparatus according to claim 1, further comprising at least one of:

a sensing unit including a sensor configured to detect a position of the printing medium; and a computation unit including at least one processor configured to calculate a position of the printing medium according to a conveying velocity of the printing medium.

8. The image forming apparatus according to claim 1, wherein the distance between the arbitrary point and the nip is from 10 mm to 60 mm.

9. The image forming apparatus according to claim 1, wherein the distance between the deceleration start point and the nip is less than a radius of the photoconductor drum.

10. A method of reducing image banding of an image forming apparatus, comprising:

determining an arbitrary point as the acceleration start point, wherein a distance between the arbitrary point and a nip formed between a photoconductive drum of a photoconductor unit and a transfer roller of a transfer unit is less than a radius of the photoconductor drum;

determining a deceleration start point that is farther from the formed nip than the determined acceleration start point based on the determined acceleration start point;

conveying a printing medium toward the determined deceleration start point, at a first conveying velocity;

conveying the printing medium at a second conveying velocity that is lower than the first conveying velocity from the determined deceleration start point toward the determined acceleration start point;

conveying the printing medium at a third conveying velocity that is different from the second conveying velocity from the determined acceleration start point toward the nip; and entering the printing medium into the nip at the third conveying velocity.

11. The method according to claim 10, wherein the second conveying velocity is 40% to 70% of the first conveying velocity.

12. The method according to claim 10, wherein the conveying of the printing medium at the second conveying velocity comprises decreasing a conveying velocity of the printing medium from the first conveying velocity to the second conveying velocity according to a predetermined acceleration pattern.

13. The method according to claim 12, wherein the acceleration pattern is defined by an acceleration function that uses at least one function among a linear function, a polynomial function, a square root function, an exponential function, and a logarithmic function.

14. The method according to claim 10, wherein the third conveying velocity is identical to the first conveying velocity.

15. The method according to claim 10, wherein the conveying of the printing medium at the second conveying velocity is performed by at least one conveying roller configured to rotate at a first angular velocity to convey the printing medium, and configured to rotate at a second angular velocity that is different from the first angular velocity, when the printing medium approaches the photoconductor unit.

16. The method according to claim 10, further comprising at least one of:

detecting an approach of the printing medium to the photoconductor unit; and determining whether the printing medium approaches the photoconductor unit, based on a conveying velocity of the printing medium.

17. The method according to claim 10, wherein the distance between the arbitrary point and the nip is from 10 mm to 60 mm.

18. The method according to claim 10, wherein the distance between the deceleration start point and the nip is less than a radius of the photoconductor drum.

* * * * *